US008763856B2

(12) United States Patent
Livingston et al.

(10) Patent No.: US 8,763,856 B2
(45) **Date of Patent: *Jul. 1, 2014**

(54) POWDERED AND LIQUID CHEMICAL DISPENSING AND DISTRIBUTION SYSTEM

(75) Inventors: James W. Livingston, Manton, CA (US); Michael A. Stead, Santa Cruz, CA (US); Scott D. E. Alhart, Soquel, CA (US)

(73) Assignee: Diversey, Inc., Sturtevant, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/483,675

(22) Filed: May 30, 2012

(65) Prior Publication Data

US 2012/0247565 A1 Oct. 4, 2012

Related U.S. Application Data

(63) Continuation of application No. 12/293,745, filed as application No. PCT/US2007/064200 on Mar. 16, 2007, now Pat. No. 8,240,514.

(60) Provisional application No. 60/787,583, filed on Mar. 30, 2006.

(51) Int. Cl.
*B67B 7/00* (2006.01)
*G01F 11/00* (2006.01)

(52) U.S. Cl.
USPC ..... 222/1; 222/145.5; 222/145.2; 222/135; 222/651; 68/17 R

(58) Field of Classification Search
USPC ..... 222/129, 135, 144.2, 144.5, 148, 1; 68/17 R
See application file for complete search history.

(56) References Cited

U.S. PATENT DOCUMENTS

| | | | | |
|---|---|---|---|---|
| 4,700,554 | A * | 10/1987 | Eichman et al. | 68/17 R |
| 5,435,157 | A * | 7/1995 | Laughlin | 68/17 R |
| 8,240,514 | B2 * | 8/2012 | Livingston et al. | 222/145.5 |
| 2007/0144558 | A1 * | 6/2007 | Classen et al. | 134/18 |

* cited by examiner

*Primary Examiner* — Dinh Q Nguyen
(74) *Attorney, Agent, or Firm* — Michael Best & Friedrich LLP

(57) ABSTRACT

A method for distributing powdered and liquid chemicals. The method includes introducing water into an upper end of a measuring chamber, injecting liquid chemical through an inlet located at a lower end of the measuring chamber into a chemical chamber that is fluidly coupled to a lower end of the measuring chamber until a desired volume of the liquid chemical has been introduced, pumping the desired volume of liquid chemical and at least some of the water to a washer, inserting water and a desired dose of a powdered chemical into the upper end of the measuring chamber, and transporting the powdered chemical and at least some of the water to the washer.

20 Claims, 6 Drawing Sheets

POWDERED AND LIQUID CHEMICAL DISPENSING AND DISTRIBUTION SYSTEM

RELATED APPLICATIONS

This application is a continuation of U.S. patent application Ser. No. 12/293,745 filed on Sep. 19, 2008, the entire contents of which are incorporated herein by reference.

TECHNICAL FIELD

The embodiments disclosed herein relate to chemical distribution systems and in particular to a system and method for dispensing and distributing liquid and powdered chemicals to washers.

BACKGROUND

Many industries require the frequent use of accurate dosages of chemicals. These industries include the on premise laundry (OPL) and machine ware wash (MWW) industries, where large volumes of chemicals are used daily. As these chemicals are consumed, new chemicals must be shipped to the user and distributed to their eventual point of use, such as to washing machines ("washers").

Typically, automated chemical distribution systems distribute liquid chemicals, as it is relatively easy to distribute liquids, as compared to non-liquids like powder, to their eventual point of use. However, transporting liquid chemicals to the end user presents a number of drawbacks. For example, liquid chemicals occupy a large volume, are heavy, and, therefore, are expensive to ship and transport to the end user. Furthermore, certain chemicals are more easily manufactured and stored as a non-liquid form, e.g., a powder, and, therefore, manufacturing and shipping these chemicals in a liquid form increases the complexity and cost, and decreases the usability, of such liquid chemicals.

On the other hand, non-liquid chemicals, e.g., powders, are easier to store and ship. Non-liquid chemicals are also generally less complex and expensive to manufacture. However, a non-liquid chemical is not easy to automatically distribute to its eventual point of use. However, those few automated chemical distribution systems that distribute powdered chemicals require separate automated chemical distribution systems for liquid chemical distribution. In other words, existing automated chemical distribution systems that distribute liquid chemicals to their point of use are not compatible with powdered chemicals. Such duplication of automated chemical systems substantially increases the overall complexity and cost of automatically distributing chemicals to their points of use.

In light of the above, it would be highly desirable to provide a single chemical distribution system that can distribute accurately dosages of both liquid and powdered chemicals.

SUMMARY

According to some embodiments there is provided a method for distributing powdered and liquid chemicals. Water is introduced into an upper end of a measuring chamber. A liquid chemical is then injected into a chemical chamber that is fluidly coupled to a lower end of the measuring chamber until a desired volume of the liquid chemical has been introduced. The desired volume of liquid chemical and at least some of the water is pumped to a washer. Water and a desired dose of a powdered chemical may then be inserted into the upper end of the measuring chamber, and thereafter transported to the washer.

According to some other embodiments there is provided a method for distributing powdered and liquid chemicals. Water is introduced into an upper end of a chamber. A desired volume of liquid chemical is introduced into a bottom end of the chamber. The desired volume of liquid chemical and at least some of the water is then pumped to one washer of multiple washers. A desired dose of a powdered chemical and water is then introduced into an upper end of the chamber. The powdered chemical and at least some of the water is subsequently pumped to the one washer.

According to some other embodiments there is provided a method for distributing powdered and liquid chemicals. Water is introduced into an upper end of a chamber. A desired volume of liquid chemical is introduced into a bottom end of the chamber. The desired volume of liquid chemical and at least some of the water is then pumped to one washer of multiple washers. A desired dose of a powdered chemical and water then introduced into an upper end of the chamber. The powdered chemical and at least some of the water is subsequently pumped to the one washer.

In many of these various systems and methods flow of liquid is achieved with gravity feed only, where each subsequent lower chamber or tubing has a smaller size or diameter than the chamber above it. Not only does this keep liquid chemicals, powdered chemicals, and/or other chemicals from sticking to the walls of the system (which can damage the system or cause harmful chemical reactions within the system), the downsizing of chambers, and or tubing, produces a higher velocity at the exit point to help clean out or flush the system of chemicals. Also, the system is continually flushed with water before, during and after the liquid or powdered chemicals are introduced into the system. This also helps to keep the unit clean and free of harmful residue.

Accordingly, the above described systems and methods provide a single chemical distribution system and method, whereby accurate dosages of both liquid and powdered chemicals can be distributed along a single line to each of multiple washers.

BRIEF DESCRIPTION OF THE DRAWINGS

For a better understanding of the nature and objects of the invention, reference should be made to the following detailed description taken in conjunction with the accompanying drawings, in which.

Like reference numerals refer to the same or similar components throughout the several views of the drawings.

DETAILED DESCRIPTION

The following describes various embodiments of chemical distribution systems and methods. These systems are particularly well suited for on premise laundry (OPL) and machine ware wash (MWW) applications. However, it should be appreciated that the systems and methods described herein may be used for any suitable chemical distribution applications.

Figure 1:
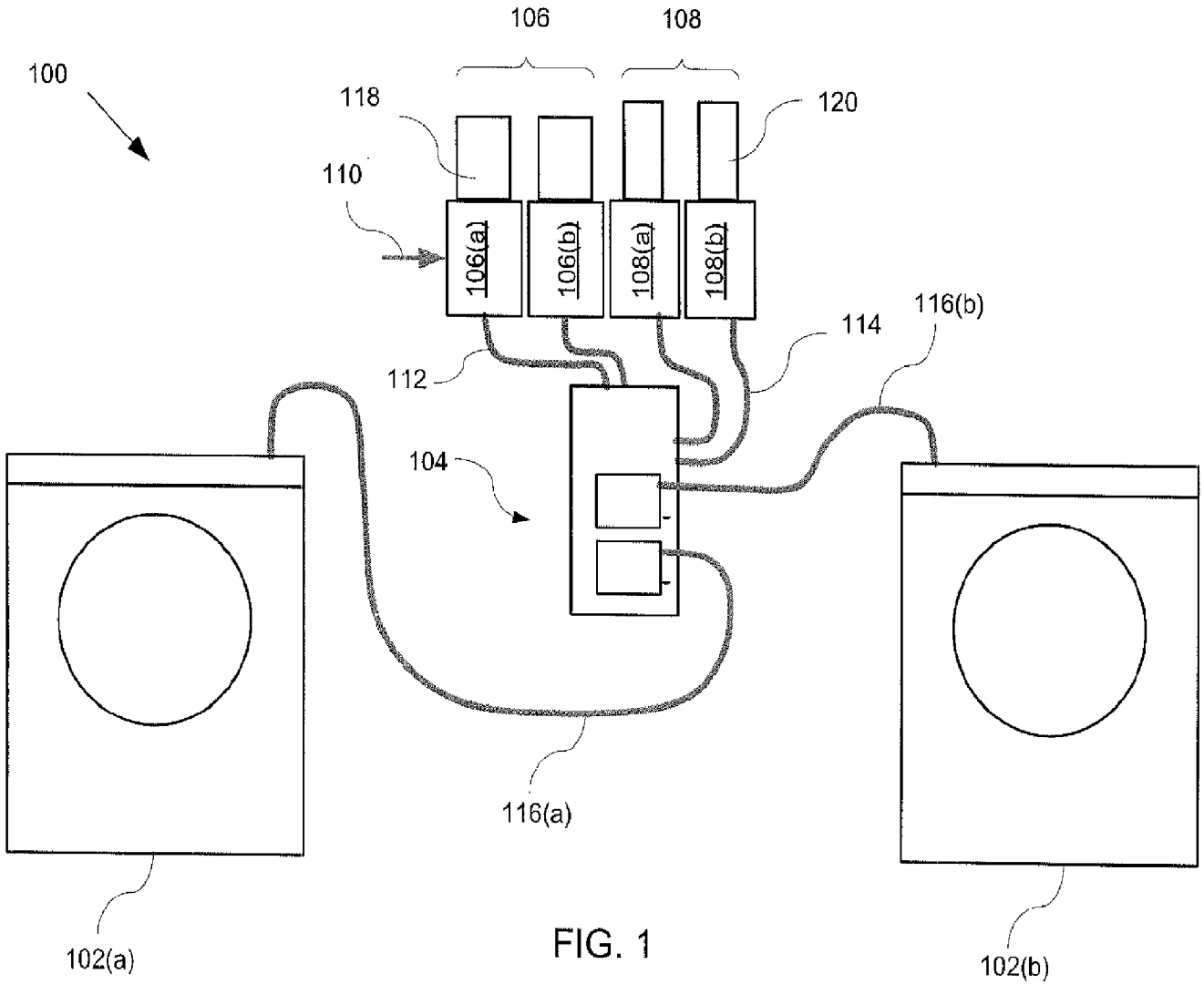
FIG. 1 is a block diagram of a powdered and liquid chemical distribution system, according to an embodiment of the invention.

FIG. 1 is a block diagram of a powdered and liquid chemical distribution system 100. The system 100 includes a chemical distribution hub 104 (sometimes referred to as a transport module) that dispenses and/or distributes water and one or more chemicals to devices, such as washers 102(*a*) and 102 (*b*), along tubes or lines 116. In some embodiments, only a single tube or line is run to each device, unlike current systems which typically require more than one line to each device, as will be explained in further detail below.

Water is supplied from one or more water sources 110, such as a municipal or city water supply. One or more powdered chemicals may be provided by one or more powdered chemical sources 106 that are coupled to the hub 104 via one or more tubes or lines 112. In some embodiments, the water from the water source 110 is also provided to the hub 104 along the same lines 112 that supply the powdered chemical (s). Also in some embodiments, the powdered chemical sources receive disposable powdered chemical refill containers 118. A suitable powdered chemical source and/or container is disclosed in Applicant's US Patent Publication No. US 2005/0247742A 1 entitled "Metering and Dispensing Closure," the entire contents of which are incorporated herein by reference.

In addition, one or more liquid chemicals may be provided by one or more liquid chemical sources 108 that are coupled to the hub 104 via one or more tubes or lines 114. In some embodiments, the powdered chemical sources receive disposable liquid chemical refill containers 120. In other embodiments, one or more liquid chemicals may be supplied from a tank that is refilled, or the like.

Figure 2:
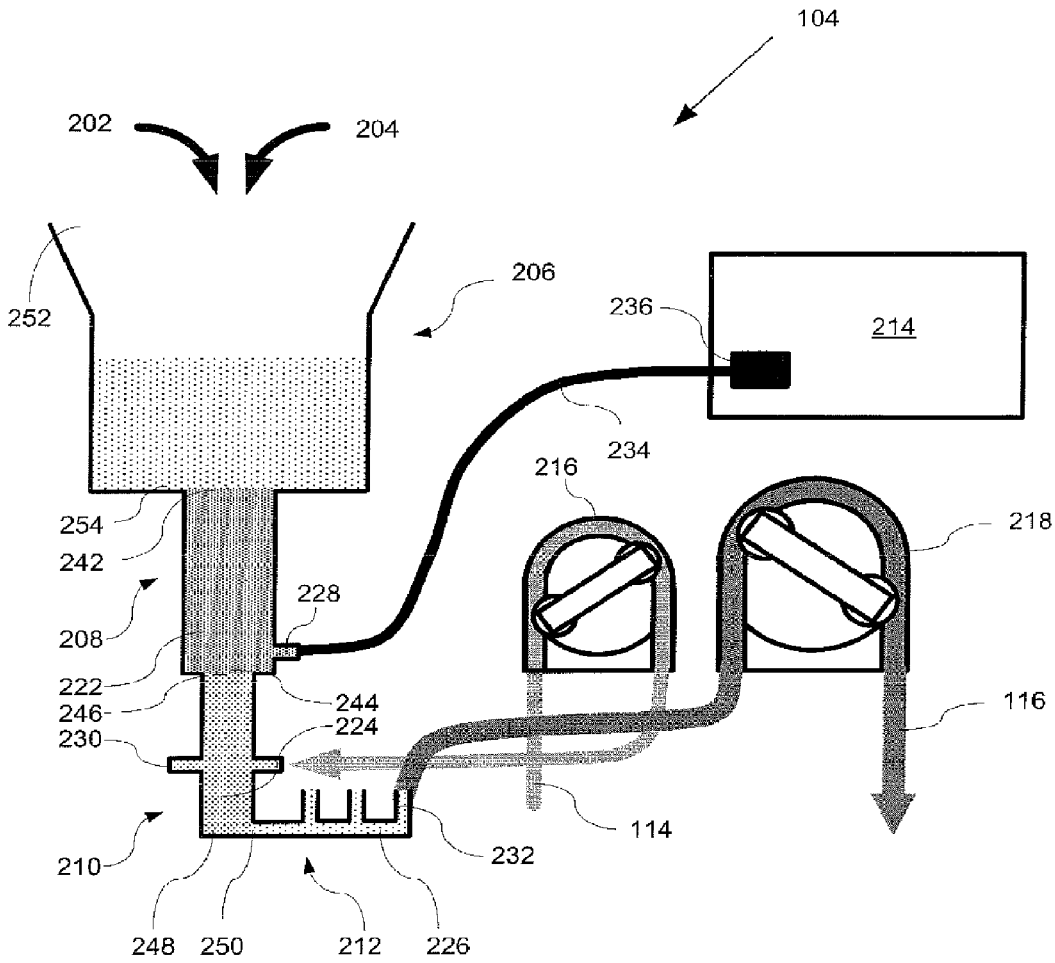
FIG. 2 is a partial cross-sectional view of the chemical distribution hub of the chemical distribution system shown in FIG. 1.

FIG. 2 is a partial cross-sectional view of the chemical distribution hub 104 of the chemical distribution system 100 shown in FIG. 1. In some embodiments, the hub 104 includes three chambers. It should however be appreciated that more or less chambers may be used. The three chambers include a measuring chamber ("first chamber") 208, a chemical chamber ("second chamber") 210, and a transport chamber ("third chamber") 206. In some embodiments, the three chambers are aligned with one another in use so that the third chamber 206 is disposed vertically above the first chamber 208, and the first chamber 208 is disposed vertically above the second chamber 210, i.e., aligned along a vertical line that is perpendicular to the horizon. In some embodiments, the three chambers are aligned with one another such that fluid can flow under a gravitational force from the third chamber 206 to the first chamber 208, and from the first chamber 208 to the second chamber 210.

The first chamber 208 is defined by at least one first chamber wall. In some embodiments the first chamber wall is a circular wall that defines a cylinder having a first diameter 01. The volume of the chamber is selected such that any change in fluid level in the chamber is great enough to allow easy sensing of the change in pressure by a sensor, described below, while retaining the water volume low enough to allow rapid flushing at the end of a dose cycle. A suitable range of first diameters and heights of the first chamber are 0.5-2 inches and 4 to 10 inches, respectively. The first chamber 208 has a first chamber first end 242, an opposing first chamber second end 244, and a port 228. The first chamber first end 242 is configured to receive into the first chamber 208: (i) water 202, from a water source 110 (FIG. 1), and/or (ii) one or more powdered chemicals 204, from one or more powdered chemical sources 106 (FIG. 1). The port 228 is formed in the first chamber wall. In some embodiments, the port 228 is situated near the first chamber second end 244. Also in some embodiments, the port has a diameter that is significantly larger than the pressure sensor input tube to create a trapped air pocket between the chamber and the pressure sensor input tube. Also in some embodiments, the diameter of the port 228 is chosen so that water is not drawn or held in the port by a capillary action. In some embodiments, the height of the first chamber that is used for calibration is in the range of 2 to 6 inches above the port 228.

The port 228 allows fluid communication into the first chamber 208. The port 228 is configured to be coupled to a sensor 236. In some embodiments, the sensor 236 is a pressure sensor, such as an absolute pressure sensor, that measures the head of fluid in the first chamber 208 above the port 228. In some embodiments, the sensor 236 is disposed within a controller 214. The controller 214 is configured to calibrate the chemical distribution system, control the flow of water and chemicals into the hub 104, and control the flow of water and chemicals to the various devices 102 (FIG. 1), as described in further detail below.

The second chamber 210 is defined by at least one second chamber wall. In some embodiments the second chamber wall is a circular wall that defines a cylinder having a second diameter D2. In some embodiments, the first diameter 01, i.e., the diameter of the first chamber is larger than the second diameter D2, i.e., the diameter of the second chamber. The second diameter is chosen to be large enough to allow liquid chemicals to be injected into the second chamber, but small enough to facilitate high velocities of water to flush any liquid chemical residue from the second chamber. A suitable range second diameters and heights of the second chamber are 0.25 to 1.75 inches and 5 to 11 inches, respectively. The second chamber 210 has a second chamber first end 246, an opposing second chamber second end 248, and one or more chemical inlets 230 in the at least one second chamber wall. The second chamber first end 246 is configured to be coupled to the first chamber second end 244. Each of the one or more chemical inlets 246 allows fluid communication into the second chamber 210. In some embodiments, each of the chemical inlets is configured to be coupled to a different liquid chemical source 108 (FIG. 1). Where multiple chemical inlets are provided, but fewer chemical sources are provided, the additional inlets may be capped. Each chemical inlet 230 coupled to a chemical source, is coupled to a tube or line 114, such as a flexible plastic tube, that is coupled to the chemical source. In some embodiments, each of these chemical inlets 230 chemical source via a chemical pump 216, as shown. For example, a flexible plastic tube transporting a liquid chemical may be inserted through a positive displacement pump, such as a peristaltic pump. In some embodiments, each chemical pump 216 is located within a respective liquid chemical source 108.

The manifold 212 has a manifold inlet 250 fluidly coupled to the second chamber second end 248. In some embodiments, the manifold may be coupled to the second chamber second end via a tube or line (see FIG. 6). The manifold also includes one or more manifold outlets 232 each configured to be coupled to a different device 102 (FIG. 1). Where multiple manifold outlets 232 are provided, but fewer devices are provided, the additional outlets may be capped. Each manifold outlet 232 coupled to a device, is coupled to a tube or line 116, such as a flexible plastic tube, that is coupled to the chemical source. In some embodiments, each of these manifold outlets 232 is coupled to a respective device via a transport pump 218, as shown. For example, a flexible plastic tube transporting water and a chemical to a device may be inserted through a positive displacement pump, such as a peristaltic pump.

The third chamber 206 is defined by at least one third chamber wall. In some embodiments the third chamber wall is a circular wall that defines a cylinder having a third diameter 03. Also in some embodiments, the third diameter 03, i.e., the diameter of the third chamber is larger than the first diameter 01, l.e., the diameter of the first chamber. The third chamber 206 has a larger diameter to facilitate larger volumes of, particularly of water, to be transported once calibration has taken place. The larger diameter also provides an overflow volume in case of failure of the sensor 236, i.e., if the sensor fails, the water entering the third chamber can rise without overflowing until the flow of water is automatically stopped by the controller after a predetermined time period. A suitable range of third diameters are 3 to 7 inches. The third chamber 206 includes a third chamber first end 252 and a third chamber second end 254. The third chamber first end 252 is configured to receive water 202 and chemicals 204 into the third chamber 206. For example, water 202 is received from at least one water source 110 (FIG. 1) and one or more powdered chemical(s) 204 are received from the powdered chemical source(s) 106 (FIG. 1). The third chamber second end 254 is located opposite the third chamber first end 252. The third chamber second end 254 is fluidly coupled to the first chamber first end 242.

In use, the chemical distribution system may first be initialized to: ensure that the water level is known and ready for feed or distribution, to measure sensor offset, and to compensate for drift of the sensor output. First, the controller 214 may verify communication with the remote chemical sources, valves, pumps, etc. One or more of the transport pump(s) 218 are then run until the sensor 236 measures that the level in the first chamber has stopped dropping, i.e., the fluid in the first chamber has dropped below the port 228. The controller then records the sensor output as zero offset, which is used to adjust all readings during feed or distribution to the devices. If the sensor continues to report that the level is dropping after a predetermined time period, then an error exists and the user is notified.

Next, the system checks that the transport pump and water supply are operational before starting to pump chemicals. The water supply 110 (FIG. 1) is turned on and the system waits for the level to rise above the sensor to a predetermined level. One or more of the transport pumps 218 are then turned on and the controller 214 waits for the level in the first chamber 208 to drop to just above the port 228. At that time, the transport pump is turned off.

To dispense a liquid chemical, all flow out of the manifold is stopped, e.g., pumps 216 and 218 are turned off If water is not already present in the first chamber, then water is injected from the water source 110 (FIG. 1) into the third chamber 206. The water flows into the first chamber 208 and is filled to a level just above the port 228.

The chemical(s) to be dispensed (typically a liquid chemical) are introduced into the second chamber 210 via one or more of the chemical inlets 230. This may be accomplished by turning on the chemical pump(s) 216. The entry of the chemical(s) into the second chamber 210 causes the water in the first chamber 208 to rise. The resulting change in water level in the first chamber is detected by the sensor 236, i.e., the sensor detects the change in head (pressure) in the first chamber. As the volume of the first chamber is known, the increase in pressure is used to determine the volume of chemical(s) being injected. When the desired volume has been reached, flow of the chemical(s) into the second chamber 210 is stopped, e.g., the chemical pump(s) 216 are turned off by the controller 214. The chemical(s) and water are then distributed to a desired device 102 (FIG. 1). This may be accomplished by, for example, turning on one of the transport pumps 218 for a predetermined amount of time sufficient to pump the chemical(s) and water to a desired device 102 (FIG. 1). The water that follows the chemical(s) to the device has the added advantage of flushing the chemical distribution system of the chemical(s).

Where larger dosages of liquid chemicals are to be dispensed and distributed, the chemical to be dispensed (typically a liquid chemical) is introduced into the second chamber 210 via one or more of the chemical inlets 230. This may be accomplished by turning on the chemical pump 216. The entry of the chemical into the second chamber 210 causes the water in the first chamber 208 to rise. The resulting change in water level in the first chamber is detected by the sensor 236, l.e., the sensor detects the change in head (pressure) in the first chamber. As the volume of the first chamber is known, the increase in pressure is used to determine the volume of chemical being injected. When a predetermined volume has been injected, flow of the chemical into the second chamber **2*i* 0 is stopped by the controller 2*i*4 turning off the chemical pump 216. The controller 214 also measures the time that it takes the chemical pump 216 to inject the predetermined volume. The controller 14 uses the predetermined volume and the measured time to determine the flow rate of the liquid chemical being injected by the chemical pump 216. Using this calculated flow rate, the controller turns on the chemical pump 216, a flow of water, and the transport pump 218 until the larger dosages of liquid chemical has been dispensed and distributed. During this dispensing and distributing phase, the controller maintains the level of water in the third chamber by measuring the pressure and turning on or off the transport pump 218 and/or water flow into the third chamber. The larger volume of the third chamber allows for some variation in water volume in the third chamber as the level is maintained. In this way larger dosages of liquid chemicals may be distributed to a desired device 102 (FIG. 1**). As described above, the water that follows the chemical(s) to the device has the added advantage of flushing the chemical distribution system of the chemical(s).

To dispense a powdered chemical, a known dose of powdered chemical 204 and water 202 is introduced into top of the third chamber 206. The water and powdered chemical mix is then distributed to a desired device 102 (FIG. 1). An advantage of this system is that the powdered chemicals may be distributed to each device along the same single line as the liquid chemicals. This may be accomplished by, for example, turning on one of the transport pumps 218. More water may then be injected into the third chamber 206 to flush the chemical distribution system of the chemical.

The above described chemical distribution system and method allows the controller 214 to accurately dispense a desired dose of powdered and/or liquid chemicals to a ware wash or laundry washer along a single tube or line 116.

Figure 3:
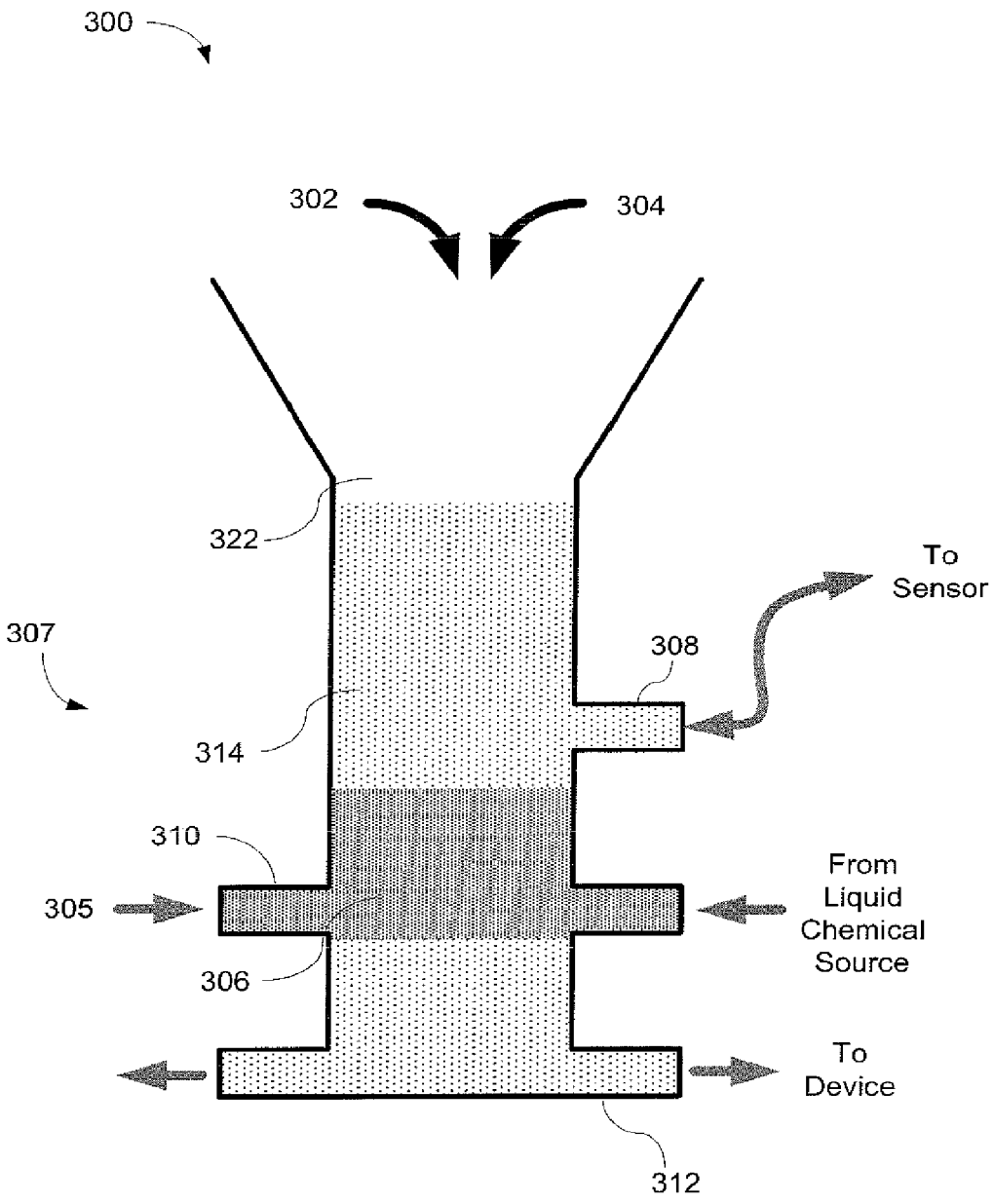
FIG. 3 is a partial cross-sectional view of another chemical distribution hub, according to another embodiment of the invention.

FIG. 3 is a partial cross-sectional view of another chemical distribution hub 300. Chemical distribution hub 300 is configured to receive water 302, one or more powdered chemicals 304, and one or more liquid chemicals 305. Unlike the hub 104 shown in FIG. 2, the hub 300 includes only a single chamber 307. The chamber 307 is defined by at least one chamber wall. In some embodiments the chamber wall is a circular wall that defines a cylinder having a predetermined diameter D. The volume of the chamber is selected such that any change in fluid level in the chamber is great enough to allow easy sensing of the change in pressure by a sensor, while retaining the water volume low enough to allow rapid flushing at the end of a dose cycle. A port 308 is formed in the chamber wall that allows fluid communication into the chamber. The port 308 is coupled to a sensor. In some embodiments, the sensor is a pressure sensor, such as an absolute pressure sensor, that measures the head of fluid above the port 308. In some embodiments, the sensor 236 (FIG. 2) is disposed within a controller (not Shown), which calibrates the chemical distribution system, controls the flow of water and chemicals into the hub, and controls the flow of water and chemicals to the various devices 102 (FIG. 1).

The chamber 307 also includes one or more liquid chemical inlets 310 in the chamber wall below the port 308, and one or more outlets 312 that are each configured to be coupled to a different device 102 (FIG. 1). In use, liquid chemicals 306 are introduced into the chamber through the chemical inlets 310, and powdered chemicals 304 are introduced into the chamber through the top of the chamber 322. The water and chemicals are distributed to the devices through the outlets 312. Calibration, dosage, measurement, distribution and other control occurs in a similar manner to that described above in relation to FIG. 2.

Figure 4:
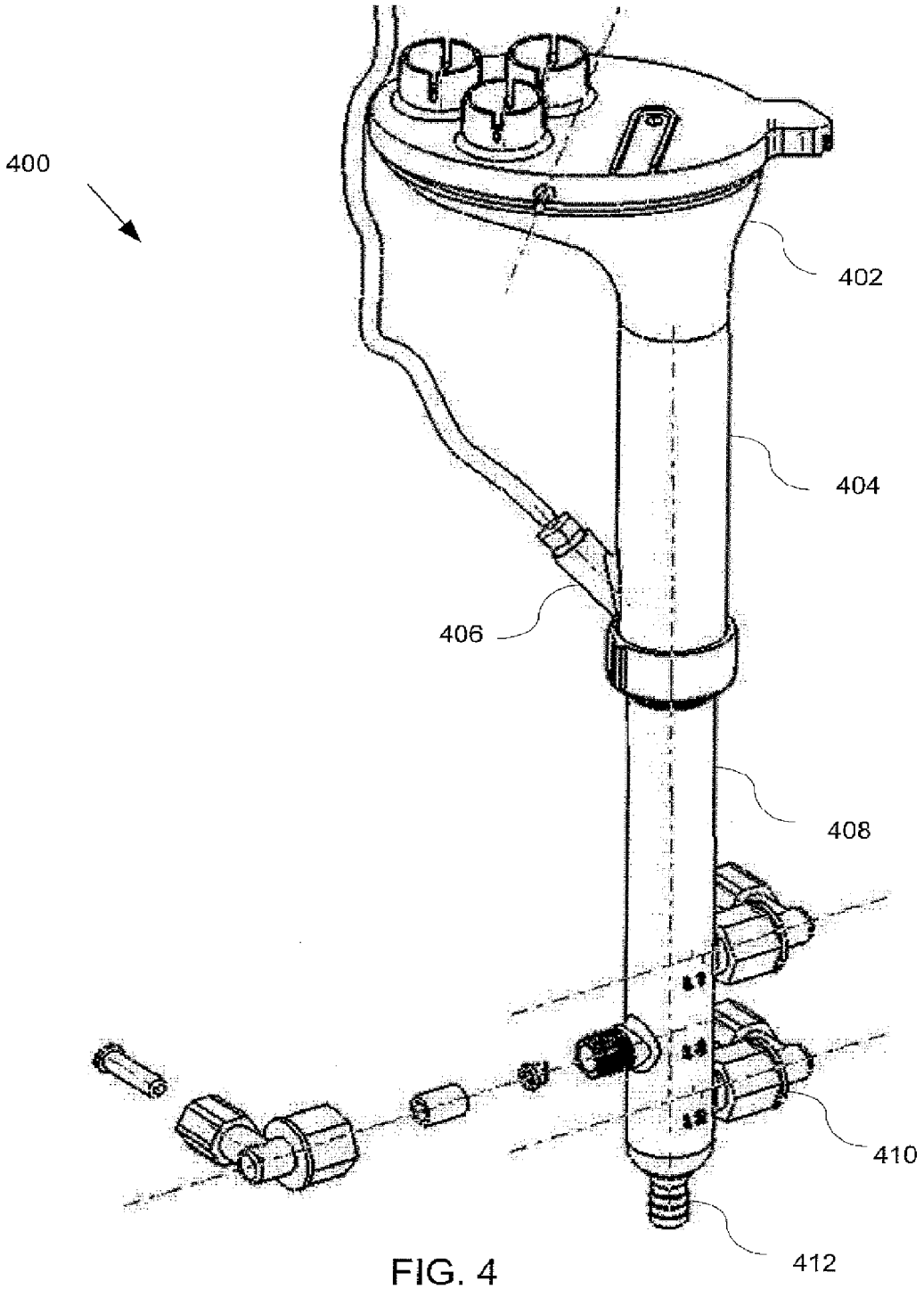
FIG. 4 is a perspective view of the chambers component of a chemical distribution hub, according to another embodiment of the invention.

FIG. 4 is a perspective view of the chambers component of a chemical distribution hub 400, according to another embodiment of the invention. The hub 400 includes many of the same components as described above in relation to FIG. 2. For example, hub 4 includes a first chamber 404 that is similar to the first chamber 208 (FIG. 2), a second chamber 408 that is similar to the second chamber 210 (FIG. 2), a third chamber 402 that is similar to the third chamber 206 (FIG. 2), three chemical inlets 410 that are similar to the chemical inlets 230 (FIG. 2), and a port 406 coupled to a sensor that is similar to the port 228 (FIG. 2). In some embodiments, the port 406 is disposed at an acute angle to the first chamber wall so that the port drains as the water level drops during flushing of water and chemical(s) to the devices 102 (FIG. 1). Although each of the first, second, and third chambers are shown in FIG. 2 as having stepped boundaries, in this embodiment the boundaries between chambers are graduated, e.g., the diameters of the chambers change gradually so that fluid easily drains from the chambers and there is no powder build-up. The hub 400 also includes an outlet port 412 that is coupled to a manifold via tube or line, as shown and described in relation to FIG. 6. A suitable range of diameters for the outlet port 412 is ⅛ to 1 inches.

Figure 5:
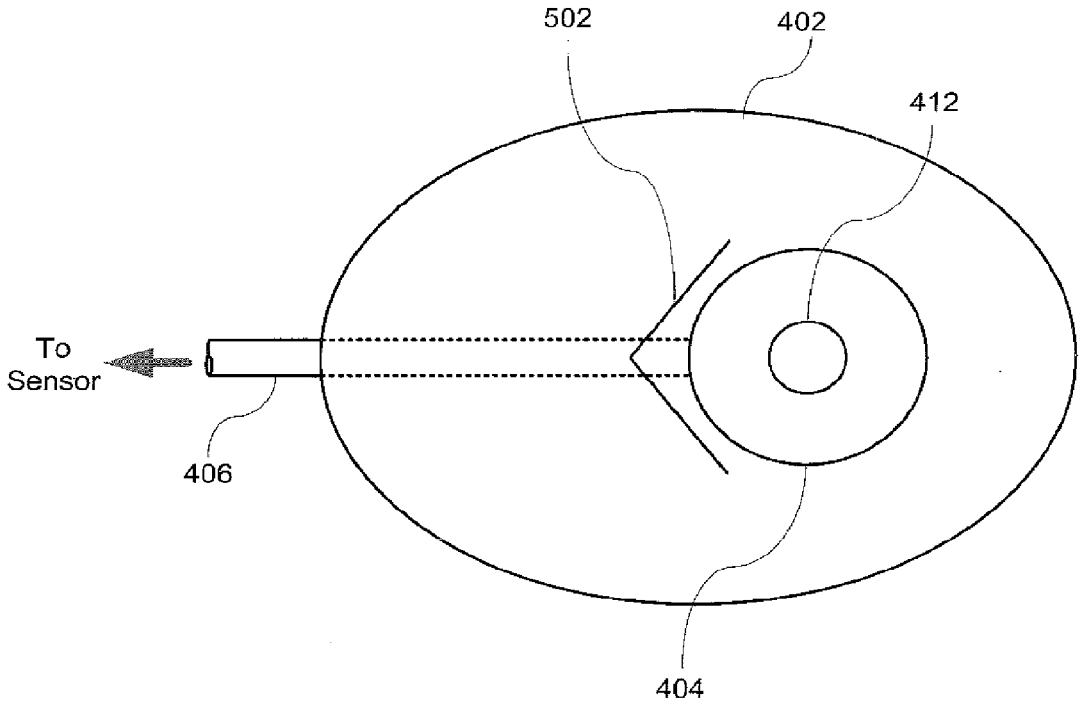
FIG. 5 is a top view looking into the third chamber of FIG. 4.

FIG. 5 is a top view looking into the third chamber 402 of FIG. 4. To prevent false readings of the sensor that may occur when water or chemicals entering the first chamber 402 pass directly over the port 406, a baffle 502 is positioned in the first chamber 402 above the port 406. The baffle 502 may be coupled to the wall of the first chamber. In some embodiments, the baffle 502 is formed in an angled shape to deflect water and chemicals away from the port 406. The baffle 502 may be formed from the same material as the first, second, and third chambers, and in some embodiments may be injection molded together as a single piece together with the first, second, and third chambers, port, and chemical inlets.

Figure 6:
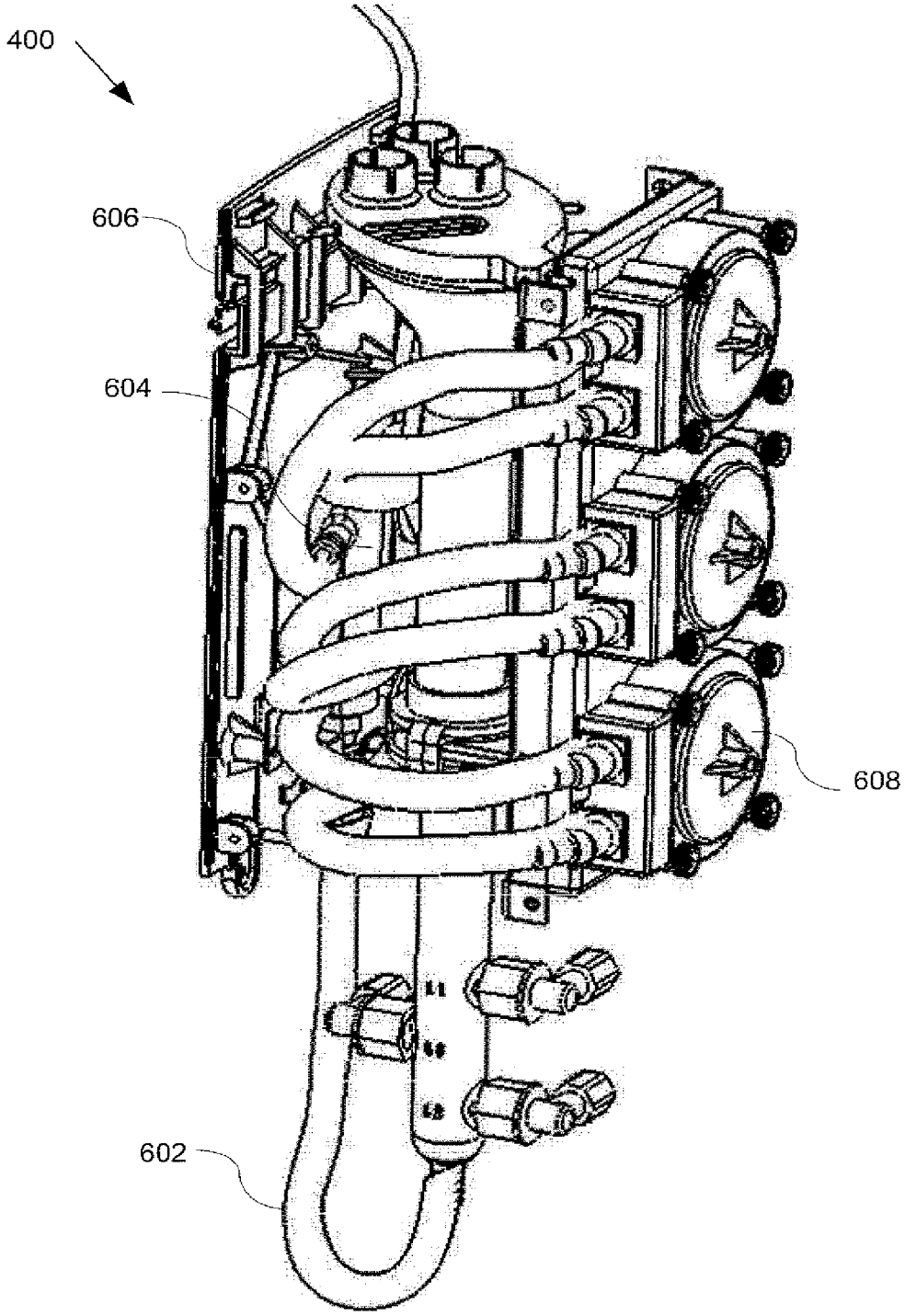
FIG. 6 is a perspective view of additional components of the hub shown in FIG. 4.

FIG. 6 is a perspective view of additional components of the hub 400 shown in FIG. 4. This view of the hub 400 includes the chambers shown in FIG. 4. The outlet 412 is fluidly coupled to a manifold 604 via a flexible tube or pipe 602. The three outlets from the manifold are in turn fluidly coupled to three separate transport pumps 608 via flexible tubes or lines. In some embodiments, the transport pumps are peristaltic pumps. Each of the flexible tubes or lines exiting the manifold is configured to be fluidly coupled to a separate device, such as a washer. In some embodiments, the chambers, manifold 604, and pumps 608 are coupled to a mounting plate 606 to allow the hub 400 to be wall mounted. The hub 400 may also house the controller 214 (FIG. 2). A housing (not shown) may connect to the mounting plate 606 to enclose the above described components.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. For example, it should be appreciated that while the above described systems and methods are directed to dispensing and distributing chemicals to washers, such as fabric washers or dishwashers, the above described systems and method may be used equally well to dispense and distribute chemicals to any other suitable devices or applications, such as water conditioners, swimming pools, etc. The presently disclosed embodiments are therefore to be considered in all respects as illustrative and not restrictive, the scope of the invention being indicated by the appended claims, and not limited to the foregoing description.

What is claimed is:

1. A method for distributing powdered and liquid chemicals, comprising:

introducing water into an upper end of a measuring chamber;

injecting liquid chemical through an inlet located at a lower end of the measuring chamber into a chemical chamber that is fluidly coupled to a lower end of the measuring chamber until a desired volume of the liquid chemical has been introduced;

pumping the desired volume of liquid chemical and at least some of the water to a washer;

inserting water and a desired dose of a powdered chemical into the upper end of the measuring chamber; and transporting the powdered chemical and at least some of the water to the washer.

2. The method of claim 1, wherein the introducing, injecting, pumping, inserting, and transporting steps are controlled by a controller to distribute liquid and powdered chemicals to the washer.

3. The method of claim 1, wherein the water is introduced from a water source via a controllable valve.

4. The method of claim 1, wherein the liquid chemical is injected from a liquid chemical source via a chemical pump.

5. The method of claim 1, wherein the pumping and transporting is facilitated by a washer pump.

6. The method of claim 1, wherein the powdered chemical is inserted from a powdered chemical distribution apparatus.

7. The method of claim 1, wherein the desired volume of the liquid chemical and the desired dose of powdered chemical and water is determined by a level sensor.

8. The method of claim 7, further comprising an initial step of calibrating the level sensor.

9. The method of dam 1, wherein the introducing, injecting, pumping, inserting, and transporting steps are repeated to distribute liquid and powdered chemicals to another washer of multiple washers.

10. A method for distributing powdered and liquid chemicals, comprising:

introducing water into an upper end of a chamber adapted to retain the water, a liquid chemical, and a powdered chemical;

introducing a desired volume of liquid chemical into the chamber through an inlet located at a lower end of the chamber;

pumping the desired volume of liquid chemical and at least some of the water to one washer of multiple washers;

introducing a desired dose of a powdered chemical and water into the upper end of the chamber;

pumping the powdered chemical and at least some of the water to the one washer.

11. The method of claim 10, wherein the water is introduced from a water source via a controllable valve.

12. The method of claim 11, wherein the introducing, introducing, pumping, introducing, and transporting steps are controlled by a controller to distribute liquid and powdered chemicals to the washer.

13. The method of claim 10, further comprising pumping the liquid chemical into the chamber via a chemical pump.

14. The method of claim 10, further comprising introducing the liquid chemical through multiple inlets each configured to be fluidly coupled to a different liquid chemical source via a different liquid chemical pump.

15. The method of claim 10, wherein the powdered chemical is inserted from a powdered chemical distribution apparatus.

16. A method for distributing powdered and liquid chemicals, comprising:

introducing a desired volume of liquid chemical into a chamber through an inlet located at a lower end of the chamber, the chamber adapted to retain the liquid chemical, a powdered chemical, and water;

pumping the desired volume of liquid chemical to one washer of multiple remote washers;

introducing a desired dose of powdered chemical and water into the chamber;

pumping the powdered chemical and at least some of the water to the one washer.

17. The method of claim 16, wherein the chamber is external to the multiple remote washers.

18. The method of claim 17, wherein the introducing, pumping, introducing, and pumping steps are controlled by a controller to distribute liquid and powdered chemicals to the one washer along a single line automatically.

19. The method of claim 17, wherein the introducing, pumping, introducing, and pumping steps are controlled by a controller to distribute liquid and powdered chemicals to another washer of the multiple remote washers along another single line automatically.

20. The method of claim 16, further comprising receiving water and the powdered chemical in a first chamber;

directing the water and the powdered chemical to a second chamber; and at least partially mixing the water and the powdered chemical with the liquid chemical in the second chamber.

* * * * *

UNITED STATES PATENT AND TRADEMARK OFFICE

CERTIFICATE OF CORRECTION

PATENT NO. : 8,763,856 B2
APPLICATION NO. : 13/483675
DATED : July 1, 2014
INVENTOR(S) : James W. Livingston, Michael A. Steed and Scott D. E. Alhart It is certified that error appears in the above-identified patent and that said Letters Patent is hereby corrected as shown below:

On the title page item (75) under the Inventors: replace the second named inventor "Michael A. Stead" with the name -- Michael A. Steed --

Signed and Sealed this
Eleventh Day of November, 2014

Michelle K. Lee

Michelle K. Lee
*Deputy Director of the United States Patent and Trademark Office*